US011571032B2

(12) United States Patent
Truesdale, III et al.

(10) Patent No.: US 11,571,032 B2
(45) **Date of Patent: *Feb. 7, 2023**

(54) FLAME RESISTANT FINISHED FABRICS EXHIBITING WATER REPELLENCY AND METHODS FOR MAKING THE SAME

(71) Applicant: Southern Mills, Inc., Union City, GA (US)

(72) Inventors: Rembert J. Truesdale, III, Thomaston, GA (US); Morgan Bakhshaee, Peachtree City, GA (US); Brian Walsh, Atlanta, GA (US); Michael Andrew Laton, Fayetteville, GA (US)

(73) Assignee: Southern Mills, Inc., Union City, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/325,682

(22) Filed: May 20, 2021

(65) Prior Publication Data

US 2021/0267293 A1 Sep. 2, 2021

Related U.S. Application Data

(63) Continuation of application No. 16/881,365, filed on May 22, 2020.

(Continued)

(51) Int. Cl.
*D06M 15/227* (2006.01)
*D06M 15/643* (2006.01)
(Continued)

(52) U.S. Cl.
CPC ..... *A41D 31/085* (2019.02); *A41D 31/10* (2019.02); *D06M 13/322* (2013.01);
(Continued)

(58) Field of Classification Search
CPC ..... A41D 31/085; A41D 31/10; D06M 15/227; D06M 15/423; D06M 15/564;
(Continued)

(56) References Cited

U.S. PATENT DOCUMENTS 6,192,520 B1 2/2001 Underwood et al.
6,511,515 B1 1/2003 Arnott et al.
(Continued)

FOREIGN PATENT DOCUMENTS

GB 1389608 A 4/1975
WO 2009/089155 A2 7/2009

OTHER PUBLICATIONS

Lucas, Memorandum to Valued Partners of Safety Components re: New Water Repellent Finish, Safety Components, Greenville, South Carolina, Dec. 19, 2019, 2 pages.
(Continued)

*Primary Examiner* — Elizabeth C Imani
(74) *Attorney, Agent, or Firm* — Kilpatrick Townsend & Stockton LLP

(57) ABSTRACT

Fabrics that are exhibit water repellency, abrasion resistance, and optionally flame resistance are described herein. The fabrics include a plurality of fibers (such as flame resistant fibers) and a finish that imparts water repellency and abrasion resistance to the fibers. The fabrics are free or substantially free from alkylfluoropolymers. Also described herein are garments including the fabrics.

20 Claims, 1 Drawing Sheet

Related U.S. Application Data

(60) Provisional application No. 62/852,647, filed on May 24, 2019.

(51) Int. Cl.

| | |
|---|---|
| ***D06M 15/423*** | (2006.01) |
| ***D06M 13/322*** | (2006.01) |
| ***D06M 15/564*** | (2006.01) |
| ***D06N 3/04*** | (2006.01) |
| ***D06M 101/30*** | (2006.01) |
| ***D06M 101/36*** | (2006.01) |
| ***A41D 31/08*** | (2019.01) |
| ***A41D 31/10*** | (2019.01) |

(52) U.S. Cl.
CPC ..... *D06M 15/227* (2013.01); *D06M 15/423* (2013.01); *D06M 15/564* (2013.01); *D06M 15/643* (2013.01); *D06N 3/042* (2013.01); *D06M 2101/30* (2013.01); *D06M 2101/36* (2013.01); *D06M 2200/12* (2013.01); *D06M 2200/30* (2013.01); *D06M 2200/35* (2013.01); *Y10T 442/2164* (2015.04); *Y10T 442/273* (2015.04)

(58) Field of Classification Search
CPC ..... D06M 15/643; D06M 13/322; D06M 2200/12; D06M 2101/30; D06M 2200/30; D06M 2101/36; D06M 2200/35; D06N 3/042; Y10T 442/2164; Y10T 442/273; Y10T 442/216
See application file for complete search history.

(56) References Cited

U.S. PATENT DOCUMENTS

| | | | |
|---|---|---|---|
| 7,118,761 | B2 | 10/2006 | Canada et al. |
| 7,132,378 | B2 | 11/2006 | Kreider et al. |
| 7,581,260 | B2 | 9/2009 | Underwood et al. |
| 7,592,048 | B2 | 9/2009 | Li et al. |
| 7,713,891 | B1 | 5/2010 | Li et al. |
| 7,741,233 | B2 | 6/2010 | Sasser et al. |
| 7,842,306 | B2 | 11/2010 | Canada et al. |
| 7,993,415 | B2 | 8/2011 | Vogt et al. |
| 7,998,886 | B2 | 8/2011 | Li et al. |
| 8,012,890 | B1 | 9/2011 | Li et al. |
| 8,012,891 | B2 | 9/2011 | Li et al. |
| 8,021,685 | B2 | 9/2011 | Canada et al. |
| 8,394,403 | B2 | 3/2013 | Canada et al. |
| 8,651,157 | B2 | 2/2014 | Michiels et al. |
| 8,653,447 | B2 | 2/2014 | Mukaibatake |
| 8,722,551 | B2 | 5/2014 | Mayernik et al. |
| 8,741,789 | B2 | 6/2014 | Li et al. |
| 8,793,814 | B1 | 8/2014 | Diianni et al. |
| 8,969,492 | B2 | 3/2015 | Fuchs et al. |
| 9,091,020 | B2 | 7/2015 | Li et al. |
| 9,453,112 | B2 | 9/2016 | Gerhardt et al. |
| 9,885,128 | B2 | 2/2018 | Cliver et al. |
| 9,926,663 | B2 | 3/2018 | Valenta et al. |
| 9,982,096 | B2 | 5/2018 | Gerhardt et al. |
| 9,994,978 | B2 | 6/2018 | Truesdale |
| 10,202,720 | B2 | 2/2019 | Cliver et al. |
| 10,655,272 | B2 | 5/2020 | Selwyn |
| 10,683,606 | B2 | 6/2020 | Hartert |
| 2003/0232560 | A1* | 12/2003 | Corner ..... D03D 1/0041 442/401 |
| 2005/0272334 | A1* | 12/2005 | Wang ..... D06M 11/49 442/93 |
| 2009/0178186 | A1 | 7/2009 | Truesdale |
| 2010/0227055 | A1 | 9/2010 | Shih et al. |
| 2015/0239007 | A1 | 8/2015 | Selwyn |
| 2016/0090505 | A1 | 3/2016 | Sworen et al. |
| 2016/0090560 | A1 | 3/2016 | Sworen et al. |
| 2017/0030010 | A1 | 2/2017 | Baumann |
| 2017/0204558 | A1 | 7/2017 | Knaup |
| 2017/0314189 | A1 | 11/2017 | Curran et al. |
| 2018/0223458 | A1 | 8/2018 | Truesdale, III |
| 2019/0301059 | A1 | 10/2019 | Flack et al. |
| 2020/0085122 | A1 | 3/2020 | Li et al. |
| 2020/0216681 | A1 | 7/2020 | Qin et al. |
| 2020/0247185 | A1 | 8/2020 | Michiels et al. |
| 2020/0346442 | A1 | 11/2020 | Sullivan et al. |
| 2020/0354498 | A1 | 11/2020 | Du et al. |
| 2020/0360735 | A1 | 11/2020 | Cantin et al. |

OTHER PUBLICATIONS

PCT Patent Application No. PCT/US2020/034212, International Search Report and Written Opinion, dated Sep. 3, 2020, 11 pages.
U.S. Appl. No. 16/881,365 , Non-Final Office Action, dated Aug. 23, 2021, 9 pages.

* cited by examiner

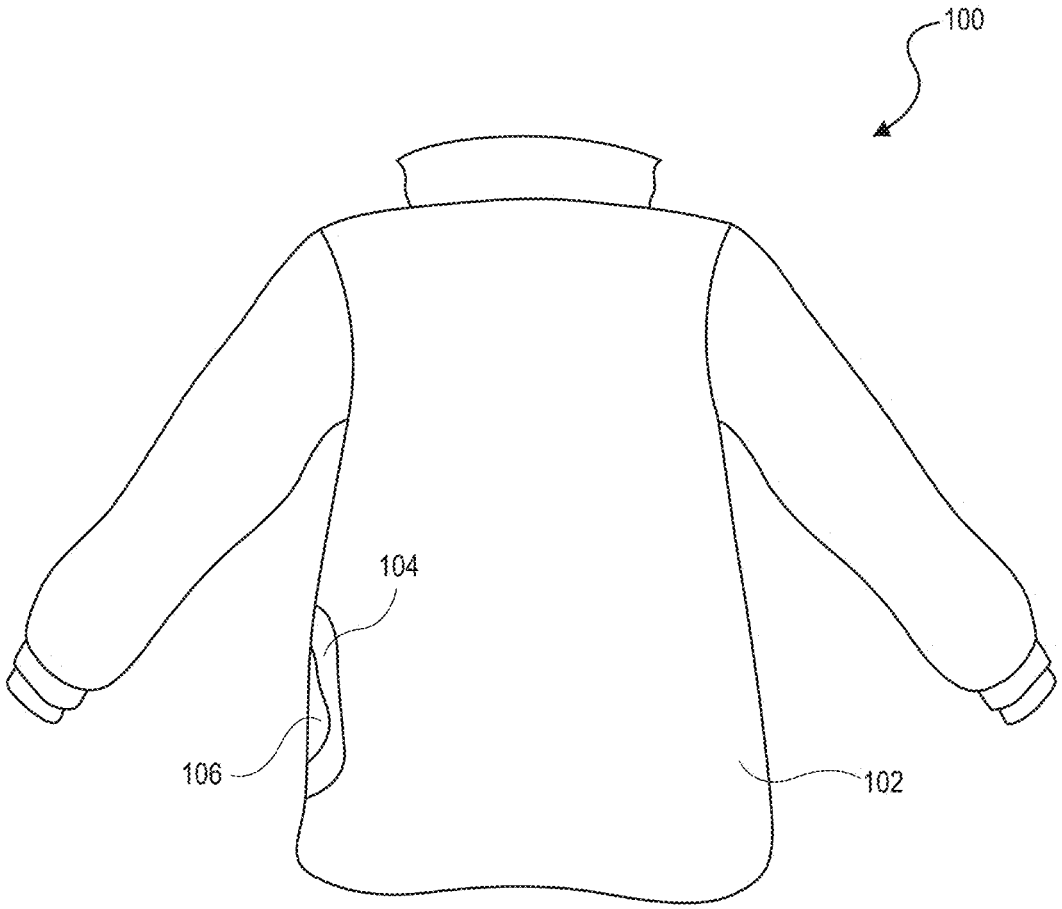
100
104
106
102

FLAME RESISTANT FINISHED FABRICS EXHIBITING WATER REPELLENCY AND METHODS FOR MAKING THE SAME

CROSS REFERENCE TO RELATED APPLICATION

This application is a continuation of U.S. patent application Ser. No. 16/881,365, filed May 22, 2020, which claims priority to U.S. Provisional Application No. 62/852,647, filed May 24, 2019, both of which are incorporated herein by reference in their entirety.

FIELD

The present disclosure relates to flame resistant fabrics that exhibit water repellency and other desirable properties, including surface abrasion resistance and/or pilling resistance. The present disclosure also relates to novel finishes for fabrics that impart water repellency and surface abrasion resistance, and methods for preparing flame resistant finished fabrics exhibiting water repellency and surface abrasion resistance.

BACKGROUND

Firefighters, emergency responders, search and rescue personnel, and those engaged in military service can be exposed to extreme heat and/or flames while working. Protective garments are designed and constructed as a way of combatting injury. These protective garments, commonly referred to as turnout gear (including coveralls, trousers, and jackets), can be constructed of special flame resistant materials designed to protect workers from both heat and flames. These garments typically include several layers of material such as an outer shell that protects the wearer from flames, a moisture barrier that prevents the ingress of water into the garment, and a thermal barrier that insulates the wearer from extreme heat.

Some individuals including, but not limited to, emergency personnel such as firefighters and other first responders, are not only exposed to extreme heat or flames, but are also exposed to water. In those instances it would be desirable for a flame resistant fabric to also have water repellant properties. Thus, turnout gear and other protective garments may include woven fabrics formed of one or more types of flame resistant fibers, and the fabrics may also have water repellant properties. These protective fabrics are expensive, so durability of the fabrics is important. Abrasion refers to the wearing away of any part of a material by rubbing against another surface. While flame resistant fibers will retain their flame resistance even if the fabric becomes abraded, a protective fabric that becomes abraded is more subject to ripping or tearing. An abraded garment may not provide the protection needed by a firefighter, emergency responder, or other individual. Therefore, if a protective garment becomes abraded, that garment must be replaced. Garments having increased abrasion resistance would need to be replaced less frequently than conventional protective garments. A fabric's resistance to abrasion can be measured by various test methodologies and equipment such as the test procedures described by ASTM standards D3886 and D3884.

It is known in the art to treat fabrics with finishes that impart a particularly useful property to the fabric. For example, many prior art finishes are water repellant finishes that include an alkylfluoropolymer. However, due to the current perception that alkylfluoropolymers and other fluoro-based chemistries may be unsafe, alternative options for finishes that impart desired properties to fabrics are needed. There remains a need for fabrics and protective garments that are water repellent, resistant to surface abrasion, and flame resistant, and that are fluorine-free due to industry demands.

SUMMARY

Described herein are water repellant and flame resistant fabrics, along with methods for making the same. A water repellant and flame resistant fabric as described herein comprises a plurality of spun yarns comprising a plurality of flame resistant fibers and a finish that imparts water repellency and abrasion resistance to the fabric. The finish comprises a water repellent agent selected from the group consisting of a hydrocarbon-based polymer, a silicone-based polymer, a urethane-based polymer, and an acrylic-based polymer, and a polymeric abrasion resistance aid. The fabric, before laundering and after being laundered five times in accordance with AATCC test method 135 (2018), has an abrasion resistance of at least about 500 cycles before a first thread break when tested in accordance with ASTM test method D3884 (2017) (H-18, 500 g on each wheel) and a water absorption of less than or equal to 15.0% as determined by NFPA 1971, 8.26 (2018). In some examples, the finish is substantially free from alkylfluoropolymers.

In some examples, the polymeric abrasion resistance aid comprises an acrylic polymer. The finish can further comprise at least one of an alkoxylated fatty amine or derivative thereof, a melamine formaldehyde resin, an N-methylol stearamide, or combinations thereof. Optionally, at least some of the plurality of flame resistant fibers are inherently flame resistant fibers comprising at least one of meta-aramid fibers, para-aramid fibers, polybenzimidazole fibers, polybenzoxazole fibers, melamine fibers, polyimide fibers, polyimideamide fibers, modacrylic fibers, and FR rayon fibers.

The abrasion resistance of the fabrics described herein can be at least about 700 cycles before a first thread break (e.g., at least about 800 cycles before a first thread break or at least about 1000 cycles before a first thread break). Optionally, the water absorption is less than or equal to 12.0% as determined by NFPA 1971, 8.26 (2018) (e.g., less than or equal to 10.0% or less than or equal to 5.0% as determined by NFPA 1971, 8.26 (2018)). In some examples, the fabric, before laundering and after being laundered the requisite number of times for each standard and in accordance with AATCC test method 135 (2018) or industrial laundering standards, meets all flammability requirements of one or more of NFPA 1951 (2013), NFPA 1971 (2018), NFPA 1977 (2016), NFPA 2112 (2018), military specification MIL-C-83429B, or military specification GL-PD-07-12. For example, the fabric, before laundering and after being laundered ten times in accordance with AATCC test method 135 (2018), meets vertical flammability requirements of NFPA 1951 (2013). Optionally, the fabric, before laundering and after being laundered one hundred times in accordance with AATCC test method 135 (2018), meets vertical flammability requirements of NFPA 1977 (2016). Optionally, the fabric, before laundering and after one hundred industrial launderings, meets vertical flammability requirements of NFPA 2112 (2018). Optionally, the fabric, before laundering and after being laundered five times in accordance with AATCC test method 135 (2018), meets vertical flammability requirements of NFPA 1971 (2018).

In some cases, the fabric, before laundering and after being laundered five times in accordance with AATCC test method 135 (2018), meets all water repellency requirements of one or both of NFPA 1951 (2013) or NFPA 1971 (2018). Optionally, the fabric meets total heat loss (THL) requirements in accordance with NFPA 1971 (2018). The fabric can comprise a plain weave, a rip-stop, a twill weave, a sateen weave, or a knitted fabric. Optionally, the fabric is stretch or non-stretch. The fabric can have a weight of less than about 8.0 osy.

Water repellant and flame resistant garments comprising the water repellant and flame resistant fabrics described herein are also provided.

Also described herein are water repellant fabrics comprising a plurality of spun yarns comprising a plurality of fibers and a finish that imparts water repellency and abrasion resistance to the fabric. The finish comprises (a) a water repellent agent selected from the group consisting of a hydrocarbon-based polymer, a silicone-based polymer, a urethane-based polymer, and an acrylic-based polymer, and (b) a polymeric abrasion resistance aid. The fabric, before laundering and after being laundered five times in accordance with AATCC test method 135 (2018), has an abrasion resistance of at least about 500 cycles before a first thread break when tested in accordance with ASTM test method D3884 (2017) (H-18, 500 g on each wheel) and a water absorption of less than or equal to 15.0% as determined by NFPA 1971, 8.26 (2018).

Further systems, methods, processes, devices, features, and advantages associated with the fabrics and garments described herein will be or will become apparent to one with ordinary skill in the art upon examination of the following drawings and detailed description. All such additional systems, methods, processes, devices, features, and advantages are intended to be included within this description, and are intended to be included within the scope of the present invention.

BRIEF DESCRIPTION OF THE DRAWINGS

FIG. 1 illustrates a partial cut-away view of a protective garment.

DETAILED DESCRIPTION

Fabrics that are exhibit water repellency, flame resistance, and/or abrasion resistance are described herein. The fabrics include a plurality of fibers (e.g., flame resistant fibers) and a finish that imparts water repellency and abrasion resistance to the fibers. The fabrics are free or substantially free from alkylfluoropolymers, but surprisingly exhibit the desired abrasion resistance and water absorption when tested according to industry-accepted standards, as further described below.

Finish Compositions

Novel finish compositions that, when applied to a fabric to form a finish, impart water repellency abrasion resistance to the fabric are described herein. The finish compositions described herein include a water repellent agent selected from the group consisting of a hydrocarbon-based polymer, a silicone-based polymer, a urethane-based polymer, and an acrylic-based polymer. The finish composition also includes a polymeric abrasion resistance aid.

Examples of suitable water repellent agents include, but are not limited to, hydrocarbon-based polymers, such as Altopel F3 and Altopel M-213-SP (available from Bolger & O'Hearn), Ruco Dry ECO Plus (a cationic hyperbranched and linear polymer available from Rudolph Group), Repellan HY-N (a cationic blend of paraffin and melamine commercially available from Pulcra Chemicals), Evo Protect DTE (a quaternary ammonium compound, paraffin dispersion available from DyStar), and Fibropel NF-22 (a hydrocarbon commercially available from FibroChem LLC); silicone-based polymers, such as Wacker CT 303 (available from Wacker Silicones), Dowsil Z-6689 (available from Dow Consumer Group and from HiTech Group), Barpel FF (available from Apollo Chemical), and NEOSEED NR-8000 (commercially available from NICCA USA); urethane-based polymers, such as Zelan R-3 (an alkyl urethane commercially available from Huntsman Chemical) and RucoPur SLR (a cationic polyurethane commercially available from Rudolph Group); and acrylic-based polymers, such as Phobotex RSY (an acrylic copolymer and paraffin wax dispersion commercially available from Huntsman Chemical). Optionally, the urethane polymers for use as water repellent agents can have relatively high elongation values (e.g., 300% or greater, such as 500% or greater).

Other suitable water repellent agents for use herein include other non-fluorine based water repellents such as SmartRepel products (e.g., SmartRepel Hydro PM and SmartRepel Hydro AM) and Arkophob FFR, each commercially available from Archroma; other Repellan products (e.g., Repellan V5), commercially available from Pulcra Chemicals; NEOSEED NR-7080, an acrylic commercially available from NICCA USA; and Nonax products (commercially available from Pulcra Chemicals).

The water repellent agent can be included in the finish composition in an amount of 5% to 20% by weight on bath (% owb) (as used herein, by weight of the finish composition bath). In some examples, the finish composition can include the water repellent in an amount of from about 6% to about 18%, from about 8% to about 17%, or about 9% to about 15% owb. For example, the finish composition can include the water repellent in an amount of about 5% owb, 6% owb, 7% owb, 8% owb, 9% owb, 10% owb, 11% owb, 12% owb, 13% owb, 14% owb, 15% owb, 16% owb, 17% owb, 18% owb, 19% owb, or 20% owb.

The finish compositions described herein also include a polymeric abrasion resistance aid. The polymeric abrasion resistance aid can be, for example, an acrylic polymer, a urethane polymer, or a combination of these. Optionally, the urethane polymers for use as polymeric abrasion resistance aids can have relatively low elongation values (e.g., less than or equal to 250%).

Examples of suitable polymeric abrasion resistance aids include, but are not limited to, urethane-based polymers, such as Eccorez FRU-33 (a hydrophobic urethane polymer available from Organic Dyes & Pigment LLC) and Dicrylan PSF (a crosslinking polyurethane available from Huntsman Chemical); and acrylic polymers such as FDP-61063 (a self cross-linking acrylic co-polymer with a Tg of +25° C., available from Omnova Solutions) and Dicrylan TA-GP (a self cross-linking ethylacrylate polymer with a Tg of −14° C., available from Huntsman Chemical).

The polymeric abrasion resistance aid(s) can be included in the finish composition in an amount of 5% to 20% by weight on bath (% owb) (as used herein, by weight of the finish composition bath). In some examples, the finish composition can include the water repellent in an amount of from about 6% to about 18%, from about 8% to about 17%, or about 9% to about 15% owb. For example, the finish composition can include the polymeric abrasion resistance aid in an amount of about 5% owb, 6% owb, 7% owb, 8% owb, 9% owb, 10% owb, 11% owb, 12% owb, 13% owb, 14% owb, 15% owb, 16% owb, 17% owb, 18% owb, 19% owb, or 20% owb.

The finish compositions can also include one or more of the following additional components: polymer extenders and other crosslinkers, silicone softeners, pH controllers, polyethylenes, wetting agents, complexing agents, sewing/abrasion polymeric acids, alkoxylated fatty amines or derivatives thereof, melamine formaldehyde resins, N-methylol stearamides, and/or flame retardant additives. Suitable polymer extenders and crosslinkers include, but are not limited to, Phobol Extender XAN (a blocked isocyanate crosslinker available from Huntsman), Evo Protect XL (a modified polyisocyanate crosslinker available from DyStar), NK ASSIST FU (an aromatic blocked-isocyanate crosslinker available from NICCA USA), and RucoLink XCR (available from Rudolph Group). Suitable silicone softeners include, but are not limited to, Ultratex SI (available from Huntsman). Suitable pH controllers include, but are not limited to, acids such as acetic acid. Suitable polyethylenes include, but are not limited to, medium and high density polyethylenes. Suitable wetting agents include, but are not limited to, Ridgewet NRW (previously called Genwet NRW and available from Blue Ridge Products) and Invadine PBN (available from Huntsman). Suitable complexing agents include Securon 540, a phosphonic acid complexing agent available from Pulcra Chemicals. Suitable sewing/abrasion polymeric aids include, but are not limited to, medium to high density polyethylene emulsions such as Aquasoft 706 (available from Apollo Chemicals, Ware Shoals, S.C.). Suitable alkoxylated fatty amines or derivatives thereof include, but are not limited to, Cartafix U (an alkoxylated fatty amine derivative product designed to inhibit finish migration and minimize pad roll build up, available from Clariant). Suitable melamine formaldehyde resins include, but are not limited to, Aerotex M3 (manufactured by Cytec Industries and available from Dystar L.P., Charlotte, N.C.) and Eccoresin M300 (available from Organic Dyes & Pigment LLC). Suitable N-methylol stearamides include, but are not limited to, Aurapel 330 (available from Star Chemicals). Suitable flame retardant additives include, but are not limited to, Flovan CGN01 (a phosphorus and nitrogen containing flame retardant additive, available from Huntsman International).

The one or more additional components, in total, can be included in the finish composition in an amount of 0.01% to 20% by weight on bath (% owb) (as used herein, by weight of the finish composition bath). In some examples, the finish composition can include the water repellent in an amount of from about 1% to about 18%, from about 3% to about 17%, or about 5% to about 15% owb. For example, the finish composition can include the polymeric abrasion resistance aid in an amount of about 0.01% owb, 0.02% owb, 0.03% owb, 0.04% owb, 0.05% owb, 0.1% owb, 0.5% owb, 1% owb, 2% owb, 3% owb, 4% owb, 5% owb, 6% owb, 7% owb, 8% owb, 9% owb, 10% owb, 11% owb, 12% owb, 13% owb, 14% owb, 15% owb, 16% owb, 17% owb, 18% owb, 19% owb, or 20% owb. The remaining amount of the finish composition can include water or another aqueous solvent.

As further described below, the finish compositions described herein impart desirable properties, including water repellency, abrasion resistance, and/or pilling resistance to fibers, fabrics, and garments upon application. According to various embodiments, a finish prepared using the finish compositions described herein is capable of improving the water repellency of the fibers, fabrics, or garments while simultaneously improving the resistance of the fibers, fabrics, or garments to surface abrasion and/or pilling. Preferably, the finish is capable of improving the water repellency and surface abrasion resistance and/or pilling resistance of a flame resistant and/or water resistant fabric without reducing the flame retardant or water resistant properties of the fabric. In some cases, the finish composition can improve the after-wash appearance of fabrics described herein (e.g., fabrics containing para-aramids) by reducing the amount of fibrillation that occurs during washing. The application of the finish to the fabric can vary depending upon the desired physical properties of the treated fabric, the composition of the fabric, and the types of fibers or body yarns selected for the fabric.

Alternatively, a finish composition as described herein can impart water repellency, abrasion resistance, and/or pilling resistance to a fabric when that finish composition is added to another finish composition that is applied to the fabric. For example, a finish composition as described herein can be added to a known finish composition such as, but not limited to, a moisture management finish, a durable press finish, or an antimicrobial finish. The combination of finishes imparts a variety of advantageous properties, depending on the finishes used, including water repellency, abrasion resistance, and/or pilling resistance.

The finish composition is free or substantially free from alkylfluoropolymers. As used herein, the term "substantially free" from an indicated component (e.g., substantially free from alkylfluoropolymers) means that the finish composition can include less than 1%, less than 0.1%, less than 0.01%, less than 0.001%, or less than 0.0001% of the component (e.g., alkylfluoropolymer) based on the weight of the finish composition.

An exemplary finish composition as described herein can include a combination of an alkyl urethane polymer as a water repellent, an acrylic polymer, a crosslinking polyurethane, a wetting agent, a blocked isocyanate cross-linker, and a silicone softener.

In some examples, an exemplary finish composition as described herein can include a combination of a hydrocarbon-based polymer as a water repellent, an acrylic polymer, a crosslinking polyurethane, a wetting agent, a blocked isocyanate cross-linker, and a silicone softener.

In other examples, an exemplary finish composition as described herein can include a combination of a cationic hyperbranched and linear alkyl polymer as a water repellent, an acrylic polymer, a crosslinking polyurethane, a wetting agent, a blocked isocyanate cross-linker, and a silicone softener.

In other examples, an exemplary finish composition as described herein can include a combination of a non-fluorine water repellent, an acrylic polymer, a wetting agent, and a silicone softener.

In still other examples, an exemplary finish composition as described herein can include a wetting agent, an acrylic polymer, a water repellent comprising an acrylic copolymer and paraffin wax dispersion, and a blocked isocyanate cross-linker.

The finish compositions can optionally include a pH controller, such as acetic acid.

Fabric

Also described herein are fabrics for applying the finish compositions described above. The fabrics can be flame resistant fabrics. For example, the fabrics can include a plurality of spun yarns comprising a plurality of fibers (e.g., flame resistant fibers). The fabrics, prior to finish application, are also referred to herein as untreated fabrics (e.g., untreated flame resistant fabrics). In one embodiment, the untreated fabrics as described herein are formed of a plurality of flame resistant fibers, such as aramid fibers (e.g., meta-aramid fibers and para-aramid fibers), polybenzimidazole (PBI) fibers, polybenzoxazole (PBO) fibers, melamine fibers, polyimide fibers, polyimideamide fibers, modacrylic fibers, FR rayon fibers, and combinations thereof.

Specific commercially available fibers suitable for use herein, either alone or in combination with other fibers, include KEVLAR® (a para-aramid), NOMEX® (a meta-aramid), TWARON® (a para-aramid), TECHNORA® (an aromatic co-polyamide), and ZYLON® (a polybenzoxazole). Other suitable fabrics include fabrics comprising non-inherently flame resistant fibers that have been rendered flame resistant by treating such fibers with a suitable flame retardant. Such fibers include, but are not limited to, nylon, cellulosic fibers such as rayon, cotton, acetate, triacetate, lyocell, and combinations thereof. A suitable fabric may be a plain weave fabric or a fabric having another configuration such as, but not limited to, rip-stop, twill weave, sateen weave, or knitted and these configurations may be stretch or non-stretch. The flame resistant fabric may additionally have water-resistant properties and/or may be treated with a water-resistant finish, separate from the finish composition described herein, to prevent or reduce water absorption from the outside environment in which a garment constructed from the fabric may be used. Optionally, the fabrics can include filament yarns and/or long staple yarns.

As noted above, in some embodiments, the fabric is a flame resistant fabric. The fabric preferably has flame resistant properties which remain after the finish composition is applied. The fabric may further have water repellant properties which also remain after the finish composition is applied. The fabric is intended to meet all flame resistance and/or water repellency requirements, as applicable, of one or more of the following: NFPA 1951, NFPA 1971, NFPA 1977, NFPA 2112, NFPA 70E, and military specifications MIL-C-83429B and GL-PD-07-12. For example, according to NFPA 1971 an outer shell fabric for firefighters must exhibit a char length of less than or equal to 4.0 inches after flame exposure and the fabric must exhibit an afterflame of less than 2.0 seconds when tested in accordance with ASTM D6413.

Methods of Preparing Finished Fabrics

The untreated fabric can be treated with a finish composition as described herein to result in a water repellant and flame resistant fabric. A variety of methodologies and associated devices can be used to apply the finish to the untreated fabric. These methodologies include, but are not limited to, spray application, padding, roll coating, applying a foam finish, and combinations thereof.

In some embodiments, the finish can be cured by applying heat and/or pressure over time to the untreated fabric, the finish, or both, until one or more components of the finish are affected. In such instances, curing may activate a particular finish component, create cross-linking with the fabric, or otherwise substantially adhere the finish to the untreated protective fabric, while removing any excess moisture that may exist in the untreated fabric and/or finish. By way of example but not limitation, a suitable curing process can be an oven drying process to apply heat to the initially treated fabric and finish for approximately 1 to 5 minutes at between about 300 and about 400° F.

In other embodiments, a finishing process can be used to apply a finish to fibers, yarns, fabrics, or garments. The following process is described by way of example, and other process embodiments can have fewer or greater numbers of steps, and may be practiced in alternative sequences. An untreated fabric comprising a plurality of flame resistant fibers is received for treatment. At this point, the untreated fabric may be substantially untreated or may be treated with a flame resistant, water resistant, or other composition, but is referred to here as "untreated" to distinguish it from the fabric as treated according to a method described herein. A finish composition as described above is applied to the untreated fabric. The finish is cured by controlling at least one of the following: heat, pressure, or time. The fabric treated by this process has improved water repellency and resistance to surface abrasion and/or pilling.

Finished Fabric Properties

The resulting finished fabrics exhibit improved water absorption and improved resistance to surface abrasion and/or pilling as compared to an untreated fabric (i.e., a fabric not treated with a finish as described herein and including at least the above-described agent and a polymeric abrasion resistance acid). The finished or treated fabric, before laundering and after being laundered five times in accordance with AATCC test method 135 (2018), has an abrasion resistance of at least about 500 cycles before a first thread break when tested in accordance with ASTM test method D3884 (2017) (H-18, 500 g on each wheel) and a water absorption of less than or equal to 15.0% as determined by NFPA 1971, 8.26 (2018), along with other properties. For example, the finished fabric described herein meets total heat loss (THL) requirements in accordance with NFPA 1971 (2018). In addition, the fabric has a weight of less than about 8.0 osy (e.g., 7.9 osy or less, 7.8 osy or less, 7.7 osy or less, 7.6 osy or less, 7.5 osy or less, 7.4 osy or less, 7.3 osy or less, 7.2 osy or less, 7.1 osy or less, 7.0 osy or less, 6.9 osy or less, 6.8 osy or less, 6.7 osy or less, 6.6 osy or less, 6.5 osy or less, 6.4 osy or less, 6.3 osy or less, 6.2 osy or less, 6.1 osy or less, or 6.0 osy or less). Other advantageous properties exhibited by the finished fabrics are further described below.

Flammability and Flame Resistance

The flammability of the finished fabrics described herein can be tested according to ASTM D6413 Standard Test Method for Flame Resistance of Textiles (Vertical Test). The finished fabrics described herein can exhibit a char length of no more than 0.8 inches in the warp direction (e.g., no more than 0.75 inches, no more than 0.70 inches, no more than 0.65 inches, no more than 0.60 inches, or no more than 0.55 inches) and 0.9 inches in the fill direction (e.g., no more than 0.85 inches, no more than 0.80 inches, no more than 0.75 inches, no more than 0.70 inches, no more than 0.65 inches, no more than 0.60 inches, or no more than 0.55 inches) before laundering. The finished fabrics described herein can also exhibit an afterglow of 35 seconds or less both before laundering and after five launderings. In addition, the finished fabrics described herein can exhibit an afterflame of less than 2.0 seconds when tested in accordance with ASTM D6413 (e.g., 1.9 seconds or less, 1.8 seconds or less, 1.7 seconds or less, 1.6 seconds or less, 1.5 seconds or less, 1.4 seconds or less, 1.3 seconds or less, 1.2 seconds or less, 1.1 seconds or less, 1.0 seconds or less, 0.9 seconds or less, 0.8 seconds or less, 0.7 seconds or less, 0.6 seconds or less, 0.5 seconds or less, 0.4 seconds or less, 0.3 seconds or less, 0.2 seconds or less, 0.1 seconds or less, or 0.0 seconds.

In some examples, the finished fabric, before laundering and after being laundered the requisite number of times for each standard and in accordance with AATCC test method 135 (2018) or an industrial laundering standard, meets all flammability requirements of one or more of NFPA 1951 (2013), NFPA 1971 (2018), NFPA 1977 (2016), NFPA 2112 (2018), military specification MIL-C-83429B, or military specification GL-PD-07-12. For example, the fabric, before laundering and after being laundered ten times in accordance with AATCC test method 135 (2018), meets vertical flammability requirements of NFPA 1951 (2013). Optionally, the fabric, before laundering and after being laundered one hundred times in accordance with AATCC test method 135 (2018), meets vertical flammability requirements of NFPA 1977 (2016). Optionally, the fabric, before laundering and after one hundred industrial launderings, meets vertical flammability requirements of NFPA 2112 (2018). Optionally, the fabric, before laundering and after being laundered five times in accordance with AATCC test method 135 (2018), meets vertical flammability requirements of NFPA 1971 (2018).

Water Repellency

The water repellant properties of the finished fabrics described herein can be determined in accordance with AATCC Test Method 22 Water Repellency: Spray Test and NFPA 1971, 8.26 Water Absorption Resistance Test. In some examples, the finished fabrics described herein have a water spray rating of at least about 70 before laundering and after being laundered five times in accordance with AATCC test method 135 (2018). In some examples, the finished fabrics described herein can have a water spray rating of 100 before laundering.

As described above, the finished or treated fabric, before laundering and after being laundered five times in accordance with AATCC test method 135 (2018), has a water absorption of less than or equal to 15.0% as determined by NFPA 1971, 8.26 (2018). For example, the water absorption, before laundering and after being laundered five times as detailed above, can be 14.5% or less, 14.0% or less, 13.5% or less, 13.0% or less, 12.5% or less, 12.0% or less, 11.5% or less, 11.0% or less, 10.5% or less, 10.0% or less, 9.5% or less, 9.0% or less, 8.5% or less, 8.0% or less, 7.5% or less, 7.0% or less, 6.5% or less, 6.0% or less, 5.5% or less, 5.0 or less, 4.5% or less, 4.0% or less, 3.5% or less, 3.0% or less, 2.5% or less, 2.0% or less, 1.5% or less, or 1.0% or less.

In some examples, the finished fabric, before laundering and after being laundered five times in accordance with AATCC test method 135 (2018), meets all water repellency requirements of one or both of NFPA 1951 (2013) or NFPA 1971 (2018). In some examples, the finished fabric continues to meet the aforementioned water repellency requirements after being laundered ten times in accordance with AATCC test method 135 (2018).

Abrasion Resistance and/or Pilling Resistance

The abrasion resistance properties of the finished fabrics described herein can be determined in accordance with ASTM D3884 Standard Test Method for Abrasion Resistance of Textile Fabrics (Rotary Platform, Double-Head Method), using H-18 wheels and a 500 g load on each wheel. As described above, the finished or treated fabric, before laundering and after being laundered five times in accordance with AATCC test method 135 (2018), has an abrasion resistance of at least about 500 cycles before a first thread break when tested in accordance with ASTM test method D3884 (2017) (H-18, 500 g on each wheel), which means that the fabrics withstand at least 500 cycles before a first thread break. For example, the abrasion resistance of the finished fabrics can be at least about 550 cycles, at least about 600 cycles, at least about 650 cycles, at least about 700 cycles, at least about 750 cycles, at least about 800 cycles, at least about 850 cycles, at least about 900 cycles, at least about 950 cycles, at least about 1000 cycles, at least about 1050 cycles, at least about 1100 cycles, at least about 1200 cycles, at least about 1300 cycles, at least about 1400 cycles, at least about 1500 cycles, at least about 1600 cycles, at least about 1700 cycles, at least about 1800 cycles, at least about 1900 cycles, at least about 2000 cycles, at least about 2100 cycles, at least about 2200 cycles, at least about 2300 cycles, at least about 2400 cycles, or at least about 2500 cycles before a first thread break.

Additionally or alternatively, the finished fabrics described herein can have a pilling performance rating of at least 4 after 60 minutes and a rating of at least 3 after 90 minutes according to ASTM D3512 Standard Test Method for Pilling Resistance and Other Related Surface Changes of Textile Fabrics: Random Tumble Pilling Tester. More preferably, the finished fabrics can have a rating of at least 4 after 90 minutes and a rating of at least 3 after 120 minutes.

Garments

Also described herein are garments made from a fabric that has been treated with a finish composition as described herein. As described above, the finish composition improves the water repellency and resistance to surface abrasion and/or pilling of the fabric. Therefore, garments prepared from the finished or treated fabrics as described herein also exhibit an improved water repellency and resistance to surface abrasion and/or pilling as compared to untreated garments. The garment also exhibits flame resistant properties, which remain after the finish composition has been applied.

Preferably, the majority of the fibers of the outer surface of the protective garment of the present invention are constructed of a flame resistant material such as meta-aramid, para-aramid, flame resistant cellulosic materials (e.g. flame resistant cotton, rayon, or acetate), polybenzoxazole (PBO), or polybenzimidazole (PBI).

FIG. 1 illustrates an example of a protective garment 100 for which the fabric described herein is particularly well-suited. The garment 100 can be a firefighter turnout coat (shown in FIG. 1) or any other garment or garment layer that is flame resistant, water repellent, and surface abrasion and/or pilling resistant as described herein. Although a turnout coat is used as an example and explicitly discussed herein, a coat has been identified for purposes of example only. Accordingly, the present disclosure is not limited to firefighter turnout coats but instead pertains to substantially any garments that may be worn by a firefighter, rescue worker, military, electrical worker, petrochemical worker, or other individual to provide thermal or another type of protection. Such garments include, but are not limited to, shirts, pants, jackets, coveralls, vests, t-shirts, underwear, gloves, liners for gloves, hats, helmets, boots, and the like. The present disclosure is not limited to garments, but can include other uses for flame resistant, water repellent and pilling and/or surface abrasion resistant fabrics irrespective of their application.

The garment 100 shown in FIG. 1 includes an outer shell 102 that forms an exterior surface of the garment 100, a barrier layer 104 that forms an intermediate layer of the garment, and a thermal liner 106 that forms an interior surface of the garment 100. For general reference, the exterior surface or outer shell 102 can be directly exposed to the environment in which the user or wearer is operating, and the interior surface of the thermal liner 106 is a surface that contacts the user or wearer, or contacts the clothes the user or wearer may be wearing. In some examples, some or all of the layers 102, 104, or 106 forming garment 100 can include the flame resistant, water repellent, and pilling and/or surface abrasion resistant fabrics described herein.

The following examples will serve to further illustrate the present invention without, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention.

EXAMPLES

In the examples that follow, the following methods for were used for testing the finished fabric samples for NPFA 1971 water absorption, abrasion resistance, and vertical flammability using char length and/or afterflame testing, as further detailed below.

Water absorption resistance was measured in accordance with NFPA 1971 Protective Ensembles for Structural Fire Fighting and Proximity Fire Fighting, 8.26 Water Absorption Resistance Test, the disclosure of which is hereby incorporated by reference.

Abrasion resistance was measured in accordance with ASTM D3884, Standard Test Method for Abrasion Resistance of Textile Fabrics (Rotary Platform Double-Head Method), the disclosure of which is hereby incorporated by reference, using H-18 wheels and a 500 g load on each wheel.

Vertical flammability was measured in accordance with ASTM D6413 Standard Test Method for Flame Resistance of Textiles (Vertical Test), the disclosure of which is hereby incorporated by reference.

The fabric samples were tested either before they were washed (BW), after 5 launderings (5×), or after 10 launderings (10×). All launderings were in accordance with AATCC Test Method 135 Dimensional Changes of Fabrics after Home Laundering. Specifically, specimens are subjected to washing and drying in accordance with Machine Cycle 1: normal/cotton sturdy cycle; Washing Temperature V: 60±3° C. (140±5° F.); Washing Machine Conditions: Normal cycle with water level of 18±1 gal, agitator speed of 179±2 spm, washing time of 12 min, spin speed of 645±15 rpm and final spin time of 6 min; and Dryer Setting Conditions: cotton/sturdy cycle with high exhaust temperature (66±5° C., 150±10° F.) and a cool down time of 10 min.

The standards for flame resistance that are referred to herein are NFPA 1951, Standard on Protective Ensembles for Technical Rescue Incidents; NFPA 1971 Standard on Protective Ensembles for Structural Fire Fighting and Proximity Fire Fighting; NFPA 1977 Standard on Protective Clothing and Equipment for Wildlands Fire Fighting; NFPA 2112, Standard on Flame-Resistant Garments for Protection of Industrial Personnel Against Flash Fire; NFPA 70E Standard for Electrical Safety Requirements for Employee Workplaces; and military specifications MIL-C-83429B and GL-PD-07-12, the disclosures of which are hereby incorporated by reference.

Example 1

Exemplary finish compositions were prepared according to Tables 1-6. The finish compositions were applied to PIONEER KHAKI fabric samples (a 60/40 para-aramid/meta-aramid twill. The finish compositions were applied to the fabric samples using a dip finish pad application (5 bar/3 m/min). The fabrics were then pre-dried at 260° F. for three minutes and were then cured at a temperature ranging from 310° F. to 338° F. for one to two minutes in a Mathis Labdryer one zone electric lab tenter to provide the finished fabric samples.

TABLE 1

| Component | Component Description | 1 | 2 | 3 | 4 | 5 | 6 | 7 |
|---|---|---|---|---|---|---|---|---|
| Ridgewet NRW | wetting agent | 0.50 | 0.50 | 0.50 | 0.50 | 0.50 | 0.50 | 0.50 |
| Dicrylan PSF | crosslinking polyurethane | 6.00 | 6.00 | 6.00 | 6.00 | — | — | — |
| Zelan R-3 | alkyl urethane | 10.00 | — | — | — | — | — | — |
| Phobol Extender XAN | blocked isocyanate cross-linker | 6.00 | 6.00 | 6.00 | — | 6.00 | 6.00 | 6.00 |
| Ultratex SI | silicone softener | 2.00 | 2.00 | 2.00 | 2.00 | 2.00 | 2.00 | 2.00 |
| Dicrylan TA-GP | acrylic polymer | 14.00 | 14.00 | 14.00 | 14.00 | 14.00 | 14.00 | 14.00 |
| Altopel F3 | hydrocarbon based water repellent polymer | — | 10.00 | — | — | — | — | — |
| Altopel M-213-SP | non-fluorine water repellent | — | — | 10.00 | — | — | — | |
| Ruco Dry ECO Plus | non-fluorine water repellent; cationic hyperbranched and linear polymers | — | — | — | 8.00 | — | — | — |
| Ruco Link XCR | blocked polyisocyanate | — | — | — | 2.00 | — | — | — |
| SmartRepel Hydro PM Lig. | non-fluorine water repellent | — | — | — | — | 10.00 | — | — |
| Arkophob FFR Liq. | non-fluorine water repellent | — | — | — | — | — | 13.00 | — |
| SmartRepel Hydro AM IQ. | non-fluorine water repellent | — | — | — | — | — | — | 10.00 |
| Acetic Acid, 84% | pH controller | — | — | — | 0.04 | 0.04 | 0.04 | 0.04 |

*all numbers are percent on weight of bath with the remainder of the composition water.

TABLE 2

| Component | Component Description | 8 | 9 | 10 | 11 |
|---|---|---|---|---|---|
| Ridgewet NRW | wetting agent | 0.50 | 0.50 | 0.50 | 0.50 |
| Phobol Extender XAN | blocked isocyanate cross-linker | — | — | — | 3.00 |
| Ultratex SI | silicone softener | 2.00 | 2.00 | 2.00 | 2.00 |
| Dicrylan TA-GP | acrylic polymer | 12.00 | 12.00 | 14.00 | 14.00 |
| Repellan HY-N | cationic blend of paraffin and melamine compound; water repellent | 10.00 | 5.00 | — | — |
| Nonax 3010 | urethane binder | 2.00 | 2.00 | — | — |
| Nonax 3001-A | cyclic silicone | — | 6.00 | — | — |
| Nonax 3002-A | cyclic silicone cross-linker | — | 0.30 | — | — |
| Freepel 1225D/ EVO PROTECT DTE | quaternary ammonium compound, paraffin dispersion | — | — | 10.00 | — |
| EVO PROTECT XL | modified polyisocyanate crosslinker | — | — | 3.00 | — |
| Fibropel NF-22 | non-fluorine water repellent | — | — | — | 10.00 |

*all numbers are percent on weight of bath with the remainder of the composition water.

TABLE 3

| Component | Component Description | 12 | 13 | 14 | 15 | 16 | 17 | 18 |
|---|---|---|---|---|---|---|---|---|
| Ridgewet NRW | wetting agent | 0.50 | 0.50 | 0.50 | 0.50 | 0.50 | 0.50 | 0.50 |
| Acetic Acid, 84% | pH controller | 0.04 | 0.04 | 0.04 | 0.04 | 0.04 | — | — |
| SmartRepel Hydro PM LIQ. | non-fluorine water repellent | 10.00 | 10.00 | 5.00 | 5.00 | — | — | — |
| Arkophob FFR | non-fluorine water repellent | 4.00 | 4.00 | 13.00 | 13.00 | 16.00 | — | — |
| Phobol Extender XAN | blocked isocyanate crosslinker | 6.00 | 6.00 | 6.00 | 6.00 | 6.00 | — | 6.00 |
| Ultratex SI | silicone softener | 2.00 | 2.00 | 2.00 | 2.00 | 2.00 | 2.00 | 2.00 |
| Dicrylan TA-GP | acrylic polymer | 14.00 | 14.00 | 14.00 | 14.00 | 14.00 | 14.00 | 14.00 |
| Dicrylan PSF | polyurethane crosslinker | — | 6.00 | — | 6.00 | 6.00 | 6.00 | 6.00 |
| Freepel 1225D/EVO PROTECT DTE | quaternary ammonium compound, paraffin dispersion | — | — | — | — | — | 12.00 | 12.00 |
| EVO PROTECT XL | modified polyisocyanate crosslinker | — | — | — | — | — | 6.00 | — |

*all numbers are percent on weight of bath with the remainder of the composition water.

TABLE 4

| Component | Component Description | 19 | 20 | 21 | 22 | 23 | 24 |
|---|---|---|---|---|---|---|---|
| Ridgewet NRW | wetting agent | 0.50 | 0.50 | 0.50 | 0.50 | 0.50 | 0.50 |
| Acetic Acid, 84% | pH controller | 0.04 | 0.04 | — | — | 0.04 | 0.04 |
| SmartRepel Hydro PM LIQ. | non-fluorine water repellent | 10.00 | 12.00 | — | — | — | — |
| Dicrylan PGS | urethane polymer | 5.00 | 6.00 | 5.00 | 7.00 | — | 6.00 |
| Phobol Extender XAN | blocked isocyanate cross-linker | 6.00 | 4.00 | — | — | 4.00 | 4.00 |
| Ultratex SI | silicone softener | 2.00 | 2.00 | 2.00 | 2.00 | 2.00 | 2.00 |
| Dicrylan TA-GP | acrylic polymer | 9.00 | 6.00 | 10.00 | 7.00 | 14.00 | 8.00 |
| Freepel 1225D/EVO PROTECT DTE | quaternary ammonium compound, paraffin dispersion | — | — | 12.00 | 15.00 | — | — |
| EVO | modified | — | — | 3.00 | 3.00 | — | — |

TABLE 4-continued

| Component | Component Description | 19 | 20 | 21 | 22 | 23 | 24 |
|---|---|---|---|---|---|---|---|
| PROTECT XL | polyisocyanate crosslinker | | | | | | |
| Arkophob FFR LIQ. | non-fluorine water repellent | — | — | — | — | 17.00 | 17.00 |

*all numbers are percent on weight of bath with the remainder of the composition water.

TABLE 5

| Component | Component Description | 25 | 26 | 27* |
|---|---|---|---|---|
| Ridgewet NRW | wetting agent | 0.50 | 0.50 | 0.50 |
| Phobotex RSY | acrylic copolymer and paraffin wax dispersion | 15.00 | — | — |
| Repellan V5 | non-fluorine water repellent | — | 15.00 | 15.00 |
| Phobol Extender XAN | blocked iso-cyanate cross-linker | 6.00 | 6.00 | 6.00 |
| Dicrylan TA-GP | acrylic polymer | 8.00 | 8.00 | 8.00 |
| Securon 540 | phosphonic acid complexing agent | — | — | 1.0 |

*all numbers are percent on weight of bath with the remainder of the composition water.

TABLE 6

| Component | Component Description | 28 | 29 | 30 | 31 |
|---|---|---|---|---|---|
| Invadine PBN | wetting agent | 0.50 | 0.50 | 1.00 | 1.00 |
| Acetic Acid, 84% | pH controller | 0.14 | 0.71 | 0.04 | 0.00 |
| Phobol Extender XAN | blocked iso-cyanate cross-linker | 1.00 | 6.00 | — | — |
| Zelan R3 | alkyl urethane | 10.00 | — | — | — |
| SmartRepel Hydro AM Liq. | non-fluorine water repellent | — | 15.00 | — | — |
| Dicrylan TA-GP | acrylic polymer | — | 8.00 | — | — |
| Ruco Dry ECO Plus | non-fluorine water repellent; cationic hyperbranched and linear polymers | — | — | 10.0 | — |
| Ruco Link XCR | blocked polyisocyanate | — | — | 2.50 | 2.50 |
| Altopel F3 | hydrocarbon based water repellent polymer | — | — | | 10.0 |

*all numbers are percent on weight of bath with the remainder of the composition water.

Experimental

The finished fabric samples were tested for vertical flammability using char length testing, abrasion resistance, and NPFA 1971 water absorption, as further detailed below. All testing was performed before any laundering was performed on the finished fabric samples. The water resistance of the fabrics was determined using NFPA 1971, 8.26. According to NFPA 1971, 8.26, a specimen is mounted to an embroidery hoop and a volume of water is allowed to spray onto the specimen. Blotting paper is used to remove excess water and a 4 in×4 in square is cut from the sample. The wet sample is weighed, dried, and weighed again. The percent water absorption (PWA) is determined based on the difference in the wet and dry weights. The results for this test are shown in Table 7 below.

Each fabric sample was subjected to a standard Taber abrasion test in accordance with ASTM D3884, using H-18 wheels and a 500 g load on each wheel. According to this method a specimen is abraded using rotary rubbing action under controlled conditions of pressure and abrasive action. The test specimen, mounted on a platform, turns on a vertical axis against the sliding rotation of two abrading wheels. One abrading wheel rubs the specimen outward toward the periphery and the other inward toward the center. The resulting abrasion marks form a pattern of crossed arcs over an area of approximately 30 $cm^2$.

Each fabric sample was subjected to 250 cycles and then was inspected for thread break. If no thread break was observed the fabric sample was subjected to 250 additional cycles and was inspected again. This process continued for each fabric sample until a thread break was observed for that sample. The results of the abrasion resistance tests are shown in Table 7, below.

The flame resistant properties of the fabrics were tested according to ASTM D6413. According to this method a fabric is hung vertically and exposed to an open flame. The char length and afterglow are determined for each fabric. The char length for each fabric was determined in the warp direction (w) and in the fill direction (f). The results of this test for the fabrics described herein are shown in Table 7 below.

TABLE 7

| Sample | Finish | Water Absorption (%) | Taber Abrasion (cycles) First Sign of Wear | Taber Abrasion (cycles) Failure | Flammability-Char Length (in) Warp | Flammability-Char Length (in) Fill | Flammability-Afterglow (s) Warp | Flammability-Afterglow (s) Fill |
|---|---|---|---|---|---|---|---|---|
| A | 1 | 21.8 | | 2000 | — | 0.56 | — | — |
| B | 2 | 32.4 | 2250 | 3500 | — | 0.50 | — | — |
| C | 3 | 23.0 | | 2500 | — | 0.56 | — | — |
| D | 4 | 38.6 | | 500 | — | 0.50 | — | — |
| E | 5 | 11.9 | 750 | 1000 | — | 0.56 | — | — |
| F | 6 | 16.4 | 1250 | 1500 | — | 0.69 | — | — |
| G | 7 | 16.8 | 750 | 1000 | — | 0.38 | — | — |
| H | 8 | 28.1 | 500 | 750 | — | 0.50 | — | — |
| I | 9 | 41.6 | | 500 | — | 0.31 | — | — |
| J | 10 | 15.2 | 750 | 1250 | — | 0.31 | — | — |
| K | 11 | 30.7 | 1000 | 1250 | — | 0.44 | — | — |
| L | 12 | 17.5 | | 1750 | 0.81 | 0.88 | 12.59 | 30.62 |
| M | 13 | 33.8 | | 2500 | 0.75 | 0.94 | 11.58 | 32.44 |
| N | 14 | 16.5 | | 1750 | 0.69 | 0.81 | 15.81 | 32.03 |
| O | 15 | 34.1 | | 6000 | 0.81 | 0.75 | 19.53 | 23.92 |
| P | 16 | 32.2 | | 3000 | 0.75 | 0.81 | 8.08 | 18.15 |
| Q | 17 | 27.4 | | 2750 | 0.25 | 0.88 | 8.01 | 22.66 |
| R | 18 | 33.0 | | 5000 | 0.69 | 0.88 | 11.29 | 21.14 |
| S | 19 | 13.9 | | 3200 | 0.69 | 0.69 | — | — |
| T | 20 | 18.1 | | 2000 | 0.63 | 0.63 | — | — |
| U | 21 | 20.6 | | 1000 | 0.56 | 0.56 | — | — |
| V | 22 | 21.5 | | 2000 | 0.63 | 0.75 | — | — |
| W | 23 | 15 | | 1000 | 0.63 | 0.63 | — | — |
| X | 24 | 19.6 | | 1000 | 0.56 | 0.31 | — | — |
| Y | 25 | 5.8 | | 1300 | 0.75 | 0.81 | | |
| Z | 26 | 13.2 | | 1200 | 0.81 | 0.81 | | |
| A1 | 27 | 12.6 | | 900 | 0.69 | 0.75 | | |
| B1 | 28 | 0.7 (0.9) | | 500 | 0.625 | 0.5625 | | |
| C1 | 29 | 0.9 (1.3) | | 300 | 0.625 | 0.625 | | |
| D1 | 30 | 0.9 (0.4) | | 700 | 0.5 | 0.5625 | | |
| E1 | 31 | 0.5 (0.9) | | 300 | 0.75 | 0.75 | | |

*Numbers in parentheses indicate the re-test values.

Based on these results, many of the finish compositions presented in Table 7 do not affect the water repellent properties of the fabric and the treated fabrics pass the requirements of water resistance of NFPA 1971. In some cases, the finish compositions described herein imparted significant water repellency properties to the fabric samples (see, for example, Sample Y, Sample B1, Sample C1, Sample D1, and Sample E1). The samples displayed water absorptions values much lower than the maximum value of 15% allowed per the NFPA 1971 requirements.

The tested fabric samples presented in Table 7 withstood more cycles before breaking than untreated fabric samples. The majority of the finished fabric samples withstood at least 500 cycles before a first thread break and/or failure. These data demonstrate that the finish compositions described herein effectively impart abrasion resistance to the fabric samples.

Also, the data in Table 7 indicate that the finish compositions according to the present invention have no adverse impact on the flame resistant properties of the fabric.

Example 2

Exemplary finish compositions were prepared according to Table 8. The finish compositions were applied to PIONEER KHAKI fabric samples (a 60/40 para-aramid/meta-aramid twill. The finish compositions were applied to the fabric samples using a dip finish pad application (5 bar/3 m/min). The fabrics were then pre-dried at 260° F. for three minutes and were then cured at a temperature ranging from 300° F. to 338° F. for one to two minutes in a Mathis Labdryer one zone electric lab tenter to provide the finished fabric samples.

TABLE 8

| Component | Component Description | 32 | 33 | 34 | 35 |
|---|---|---|---|---|---|
| Invadine PBN | wetting agent | 1.00 | 1.00 | 1.00 | 1.00 |
| Acetic Acid, 84% | pH controller | 0.04 | 0.04 | 0.04 | 0.04 |
| RucoDry ECO Plus | non-fluorine water repellent; cationic hyperbranched and linear polymers | 12.00 | 10.00 | 12.00 | 10.00 |
| RucoLink XCR | blocked polyisocyanate | 3.00 | 2.50 | 3.00 | 3.00 |
| RucoPur SLR | cationic polyurethane | — | 8.00 | — | — |
| Dicrylan TA-GP | acrylic polymer | — | — | 8.00 | — |
| Altopel F3 | hydrocarbon based water repellent polymer | — | — | — | 4.00 |

*all numbers are percent on weight of bath with the remainder of the composition water.

The finished fabric samples were tested for vertical flammability using char length testing, abrasion resistance, and NPFA 1971 water absorption according to the experimental procedures described in Example 1. All testing was performed before any laundering was performed on the finished fabric samples. The data are shown in Table 9.

TABLE 9

| Sample | Finish | Water Absorption (%) | Surface Abrasion (cycles) | Flammability - Char Length (in) Warp | Fill |
|---|---|---|---|---|---|
| F1 | 32 | 0.9 | 200 | 0.7 | 0.8 |
| G1 | 33 | 2.0 | 150 | 0.7 | 0.8 |
| H1 | 34 | 10.8 | 150 | 0.6 | 0.7 |
| I1 | 35 | 3.4 | 150 | 0.5 | 0.8 |

Based on these results, the finish compositions described herein imparted significant water repellency properties to the fabric samples. The resulting samples F1, G1, H1, and I1 displayed water absorptions values much lower than the maximum value of 15% allowed per the NFPA 1971 requirements. In addition, the finish compositions described herein have no adverse impact on the flame resistant properties of the fabric.

Example 3

Exemplary finish compositions were prepared according to Table 10. The finish compositions were applied to two different fabrics. The fabrics are both woven protective fabrics containing ring-spun yarns. Fabric 1 is a PIONEER AIRO fabric, which is 60% T-970 Kevlar and 40% N303 Tan Nomex. Fabric 2 is a KOMBAT FLEX fabric, which is 54% T-970 Kevlar and 46% polybenzimidazole (PBI). Both Fabric 1 and Fabric 2 are fire service outershell fabrics. The finish compositions were applied to the fabric samples using a dip finish pad application at 40% to 65% WPU (wet pick-up). The fabrics were then dried and cured using a 60' oven with zones set at temperatures between 285° F. to 330° F. The speed used for the drying and curing step was 15 yards per minute.

TABLE 10

| Component | Component Description | DWR 1 | DWR 2 |
|---|---|---|---|
| Ridgewet NRW | wetting agent | 0.50 | 0.50 |
| Acetic Acid, 84% | pH controller | 0.04 | — |
| Smart Repel Hydro PM Liq | non-fluorine water repellent | 15.00 | — |
| Ultratex SI | silicone softener | 2.00 | — |
| Dicrylan TA-GP | acrylic polymer | 8.00 | 8.00 |
| Phobotex RSY | acrylic copolymer and paraffin wax dispersion | — | 15.00 |

TABLE 10-continued

| Component | Component Description | DWR 1 | DWR 2 |
|---|---|---|---|
| Phobol Extender XAN | blocked iso-cyanate cross-linker | — | 6.00 |

*all numbers are percent on weight of bath with the remainder of the composition water.

The finished fabric samples were tested for NPFA 1971 water absorption, abrasion resistance, and vertical flammability using char length testing, according to the experimental procedures described in Example 1. The vertical flammability testing was performed before any laundering of the finished fabric sample. The water absorption and abrasion resistance testing was performed both before laundering (indicated as "BW" in Table 11 below) and after five launderings (5×) in accordance with AATCC Test Method 135 described above. The data are shown in Table 11. The surface abrasion data show the number of taber cycles, as described above, before a first thread break was observed for that sample.

TABLE 11

| Sample | Fabric | Finish | Water Absorption (%) BW | 5x | Flammability-Char Length (in) Warp | Fill | Surface Abrasion (cycles) BW | 5x |
|---|---|---|---|---|---|---|---|---|
| J1 | 1 | DWR 1 | 13.7 | 10.5 | 0.7 | 0.7 | 800 | 500 |
| K1 | 2 | DWR 1 | 8.6 | 8.6 | 0.4 | 0.4 | 500 | 500 |
| L1 | 1 | DWR 2 | 11.1 | 4.6 | 0.5 | 0.7 | 700 | 700 |
| M1 | 2 | DWR 2 | 3.9 | 5.4 | 0.5 | 0.4 | 500 | 500 |

Based on these results, the finish compositions described herein imparted significant water repellency properties to the fabric samples. The water repellency was demonstrated in the finished fabric sample before laundering and was retained in the finished fabric sample after washing. All samples displayed water absorptions values lower than the maximum value of 15% allowed per the NFPA 1971 requirements.

The tested fabric samples presented in Table 11 withstood more cycles before breaking than untreated fabric samples. All of the finished fabric samples withstood at least 500 cycles before a first thread break. These data demonstrate that the finish compositions described herein effectively impart abrasion resistance to the fabric samples.

In addition, the finish compositions described herein have no adverse impact on the flame resistant properties of the fabric.

Example 4

Exemplary finish compositions were prepared according to Table 12. The finish compositions were applied to PIONEER KHAKI fabric samples (a 60/40 para-aramid/meta-aramid twill) using a dip finish pad application (5 bar/3 m/min). The fabrics were then dried and cured at 340° F. for three minutes in an oven. The spin speed used for the drying and curing step was 1800 rpm.

TABLE 12

| Component | Component Description | 36 | 37 | 38 | 39 |
|---|---|---|---|---|---|
| Ridgewet NRW | wetting agent | 0.25 | 0.25 | 1.00 | 1.00 |
| Acetic Acid, 84% | pH controller | 0.15 | 0.15 | — | — |
| Fibropel NF-22 | non-fluorine water repellent | 15.00 | — | — | — |
| Neoseed NR-7080 | acrylic-based polymer | | 15.00 | | |

TABLE 12-continued

| Component | Component Description | 36 | 37 | 38 | 39 |
|---|---|---|---|---|---|
| Phobol Extender XAN | blocked iso-cyanate cross-linker | 2.00 | 2.00 | — | 1.00 |
| Barpel FF New | silicone-based polymer | — | — | — | 12.00 |
| NK Assist FU | blocked iso-cyanate crosslinker | — | — | 1.00 | — |
| Neoseed NR-8000 | silicone-based polymer | — | — | 12.50 | — |

*all numbers are percent on weight of bath with the remainder of the composition water.

The finished fabric samples were tested for vertical flammability using char length testing, abrasion resistance, and NPFA 1971 water absorption according to the experimental procedures described in Example 1. All testing was performed before any laundering was performed on the finished fabric samples. The data are shown in Table 13.

TABLE 13

| Sample | Finish | Water Absorption (%) | Surface Abrasion (cycles) | Flammability - Char Length (in) Warp | Fill |
|---|---|---|---|---|---|
| N1 | 36 | 1.2 | 200 | 0.63 | 0.63 |
| O1 | 37 | 1.0 | 200 | 0.56 | 0.56 |
| P1 | 38 | 9.2 | 400 | 0.63 | 0.63 |
| Q1 | 39 | 46.7 | 300 | 0.44 | 0.56 |

The resulting samples N1, O1, and P1 displayed water absorptions values lower than the maximum value of 15% allowed per the NFPA 1971 requirements. In addition, the finish compositions described herein have no adverse impact on the flame resistant properties of the fabric.

Example 5

Exemplary finish composition 25 (see Table 5) and finish composition 30 (see Table 6) were prepared and applied to five different woven protective fabrics containing ring-spun yarns.

Fabric 3 is a GEMINI XT Natural fabric, which is 60% para-aramid and 40% polybenzimidazole. Fabric 4 is an ADVANCE fabric, which is 60% para-aramid and 40% meta-aramid. Fabric 5 is a PIONEER KHAKI fabric, which is a 60% para-aramid and 40% meta-aramid twill. Fabric 6 is an AGILITY DARK GOLD fabric, which is an aramid blended fabric. Fabric 7 is a KOMBAT FLEX fabric, which is 54% T-970 Kevlar and 46% polybenzimidazole (PBI). All fabrics are fire service outershell fabrics commercially available from TenCate Protective Fabrics (Union City, Ga.). The finish compositions were applied to the fabric samples using a dip finish pad application at 40% to 55% WPU (wet pick-up). The fabrics were then dried and cured using a 60' oven with all zones set at 330° F. The speed used for the drying and curing step was 10 yards per minute for both formulations.

The finished fabric samples were tested for NPFA 1971 water absorption, abrasion resistance, and vertical flammability using char length testing, according to the experimental procedures described in Example 1. The finished fabric samples were also tested for water repellency using AATCC Test Method 22 by testing the water spray rating. All testing was performed both before laundering (indicated as "BW") and after five launderings (indicated as "5×") or after ten launderings (indicated as "10×") in accordance with AATCC Test Method 135 described above. The surface abrasion data show the number of taber cycles, as described above, before a first thread break was observed for that sample. The data for samples prepared by applying finish composition 25 to each of Fabrics 3, 4, 5, 6, and 7 are shown in Table 14.

TABLE 14

| | Fabric 3 | Fabric 4 | Fabric 5 | Fabric 6 | Fabric 7 |
|---|---|---|---|---|---|
| Width (in) | 59.775 | 59.7 | 60.025 | 60.3625 | 60.525 |
| Weight (osy) | 7.3 | 6.9 | 6.4 | 6.3 | 6.8 |
| Construction | 42 × 40 | 57 × 45 | 47 × 45 | 47 × 46 | 45 × 43 |
| Laundry Shrinkage (%) | 2.9 × 1.8 | 1.7 × 1.2 | 1.2 × 0.5 | 1.2 × 0.3 | 2.5 × 1.6 |
| Tensile [lbf] BW | 287 × 259 | 290 × 226 | 381 × 355 | 391 × 364 | 238 × 243 |
| Tensile [lbf] AW 10x | 239 × 235 | 244 × 209 | 286 × 332 | 320 × 280 | 233 × 249 |
| Trap Tear BW [lbf] | 58 × 55 | 41 × 33 | 58 × 56 | 66 × 66 | 48 × 63 |
| Trap Tear AW 5x [lbf] | 63 × 60 | 41 × 32 | 61 × 60 | 66 × 66 | 62 × 68 |
| Vertical Flame Char Length BW [in] (warp × fill) | 0.29 × 0.14 | 0.98 × 0.54 | 0.46 × 0.41 | 0.05 × 0.04 | 0.16 × 0.18 |
| Vertical Flame Char Length AW 5x [in] (warp × fill) | 0.35 × 0.3 | 1.0 × 0.64 | 0.44 × 0.48 | 0.1 × 0 | 0.26 × 0.26 |
| Water Absorption BW [%] | 0.4 | 0.3 | 0.5 | 1.0 | 0.5 |
| Water Absorption AW 5x [%] | 2.8 | 2.6 | 1.8 | 2.0 | 2.8 |
| Water Spray BW | 100 | 100 | 100 | 100 | 100 |
| Water Spray AW 5x | 90 | 100 | 90 | 90 | 90 |
| Taber BW | 750 | 225 | 275 | 550 | 300 |
| Taber AW 5x | 550 | 300 | 325 | 350 | 325 |

The data for samples prepared by applying finish composition 30 to each of Fabrics 3, 4, 5, 6, and 7 are shown in Table 15.

TABLE 15

| | Fabric 3 | Fabric 4 | Fabric 5 | Fabric 6 | Fabric 7 |
|---|---|---|---|---|---|
| Width (in) | 59.8375 | 59.4375 | 59.925 | 60.175 | 60.2125 |
| Weight (osy) | 7.0 | 6.7 | 6.3 | 6.2 | 6.5 |
| Construction | 42 × 39 | 58 × 45 | 44 × 41 | 47 × 46 | 48 × 47 |
| Laundry Shrinkage (%) | 3.1 × 1.6 | 1.4 × 1.0 | 1.2 × 0 | 1.3 × 0.3 | 2.5 × 1.2 |
| Tensile [lbf] BW | 280 × 249 | 279 × 205 | 362 × 322 | 396 × 328 | 266 × 241 |
| Tensile [lbf] AW 10x | 260 × 216 | 261 × 209 | 318 × 323 | 307 × 292 | 255 × 241 |
| Trap Tear BW [lbf] | 53 × 57 | 43 × 35 | 65 × 69 | 71 × 71 | 65 × 70 |
| Trap Tear AW 5x [lbf] | 56 × 59 | 42 × 34 | 67 × 71 | 76 × 72 | 74 × 74 |
| Vertical Flame Char Length BW [in] (warp × fill) | 0.21 × 0.23 | 0.68 × 0.45 | 0.44 × 0.34 | 0 × 0.03 | 0.09 × 0.14 |
| Vertical Flame Char Length AW 5x [in] (warp × fill) | 0.24 × 0.25 | 0.69 × 0.5 | 0.43 × 0.45 | 0 × 0 | 0.2 × 0.25 |
| Water Absorption BW [%] | 1 | 0.5 | 0.8 | 2.5 | 0.8 |
| Water Absorption AW 5x [%] | 3.9 | 5.4 | 3.4 | 7.0 | 4.1 |
| Water Spray BW | 100 | 100 | 100 | 100 | 100 |
| Water Spray AW 5x | 80 | 80 | 80 | 70 | 70 |
| Taber BW | 250 | 150 | 250 | 275 | 225 |
| Taber AW 5x | 350 | 300 | 300 | 300 | 250 |

As controls, PIONEER KHAKI fabric ("Control 1") and KOMBAT FLEX fabric ("Control 2"), each treated with an alkylfluoropolymer containing finish, were tested using the same parameters as described above. The alkylfluoropolymer-containing finish included 2.50 g/L of a wetting agent, 2.50 g/L of a compatibilizer, 2.50 g/L of a defoamer, 60.0 g/L of a urethane antipill/abrasion aid, 140.0 g/L of an acrylic abrasion aid, 120.0 g/L of a C6 alkylfluoropolymer DWR agent, 60.0 g/L of a cross-linker, 60.0 g/L of a high density polyethylene softener, and 10.0 g/L of a nondurable flame resistant agent. The results are shown in Table 16.

TABLE 16

| | Control 1 | Control 2 |
|---|---|---|
| Width (in) | 60.25 | 60.875 |
| Weight (osy) | 6.6 | 6.8 |
| Construction | 45 × 42 | 47 × 45 |
| Laundry Shrinkage (%) | 0.5 × 1.2 | 0.9 × 0.7 |
| Tensile [lbf] BW | 381 × 364 | 254 × 333 |
| Tensile [lbf] AW 10x | 339 × 361 | 303 × 312 |
| Trap Tear BW [lbf] | 47 × 45 | 53 × 52 |
| Trap Tear AW 5x [lbf] | 47 × 47 | 58 × 63 |
| Vertical Flame Char Length BW [in] (warp × fill) | 0.45 × 0.49 | 0.28 × 0.21 |
| Vertical Flame Char Length AW 5x [in] (warp × fill) | 0.51 × 0.59 | 0.38 × 0.46 |
| Water Absorption BW [%] | 5.4 | 5.4 |
| Water Absorption AW 5x [%] | 3.7 | 5.5 |
| Water Spray BW | 90 | 70 |

TABLE 16-continued

| | Control 1 | Control 2 |
|---|---|---|
| Water Spray AW 5x | 80 | 70 |
| Taber BW | 4750 | 3200 |
| Taber AW 5x | 2500 | 650 |

Based on these results, the finish compositions 25 and 30 consistently imparted significant water repellency properties to the various fabric samples. The water repellency was demonstrated in the finished fabric sample before laundering and was retained in the finished fabric sample after washing. All samples displayed water absorptions values lower than the maximum value of 15% allowed per the NFPA 1971 requirements and water spray ratings equivalent to or higher than the untreated samples. In addition, the finish compositions described herein have no adverse impact on the flame resistant properties of the fabric.

Example 6

Exemplary finish compositions were prepared according to Tables 17 and 18. The finish compositions were applied to PIONEER KHAKI fabric samples (a 60/40 para-aramid/meta-aramid twill) using a dip finish pad application (5 bar/3 m/min). The fabrics were then dried at 260° F. for three minutes and cured at 330° F. for one minute in an oven. The spin speed used for the drying and curing steps was 1800 rpm.

TABLE 17

| Component | Component Description | 40 | 41 | 42 | 43 | 44 |
|---|---|---|---|---|---|---|
| Ridgewet NRW | wetting agent | 0.50 | 0.50 | 0.50 | 0.50 | 0.50 |
| Dicrylan TA-GP | acrylic polymer | 8.00 | 8.00 | 8.00 | 8.00 | 8.00 |
| Dicrylan PGS | urethane polymer | — | 10.00 | 10.00 | — | 10.00 |
| Phobotex RSY | acrylic copolymer and paraffin wax dispersion | 15.00 | 15.00 | 25.00 | 25.00 | — |
| Phobol Extender XAN | blocked iso-cyanate cross-linker | 6.00 | 6.00 | 6.00 | 6.00 | 6.00 |
| Repellan V5 | non-fluorine water repellent | | | | | 15.00 |

*all numbers are percent on weight of bath with the remainder of the composition water.

TABLE 18

| Component | Component Description | 45 | 46 | 47 | 48 | 49 |
|---|---|---|---|---|---|---|
| Ridgewet NRW | wetting agent | 0.50 | 0.50 | 0.50 | 0.50 | 0.50 |
| Dicrylan TA-GP | acrylic polymer | 8.00 | 8.00 | 8.00 | 8.00 | 8.00 |
| Dicrylan PGS | urethane polymer | — | 10.00 | 10.00 | — | 10.00 |
| Phobol Extender XAN | blocked iso-cyanate cross-linker | 6.00 | 6.00 | 6.00 | 6.00 | 6.00 |
| Repellan V5 | non-fluorine water repellent | — | — | | — | 15.00 |
| Acetic Acid, 84% | pH controller | 0.04 | 0.04 | 0.04 | 0.04 | 0.04 |
| Smart Repel Hydro PM Liq | non-fluorine water repellent | 15.00 | 15.00 | 25.00 | 25.00 | — |
| Ultratex SI | silicone softener | 2.00 | 2.00 | 2.00 | 2.00 | 2.00 |

*all numbers are percent on weight of bath with the remainder of the composition water.

The finished fabric samples were tested for NPFA 1971 water absorption, abrasion resistance, and vertical flammability using char length testing, according to the experimental procedures described in Example 1. The vertical flammability, water absorption, and abrasion resistance testing was performed both before laundering (indicated as "BW" in Table 19 below) and after five launderings (5×) in accordance with AATCC Test Method 135 described above. The data are shown in Table 19. The surface abrasion data show the number of taber cycles, as described above, before a first thread break was observed for that sample.

TABLE 19

| | | Water Absorption (%) | | Flammability-Char Length (in) | | Surface Abrasion (cycles) | |
|---|---|---|---|---|---|---|---|
| Sample | Finish | BW | 5x | BW | 5x | BW | 5x |
| R1 | 40 | 7.9 | 5.1 | 0.31 | 0.50 | 400 | 400 |
| S1 | 41 | 7.4 | 7.8 | 0.50 | 0.20 | 2500 | 1400 |
| T1 | 42 | 7.3 | 6.8 | 0.44 | 0.44 | 2500 | 900 |
| U1 | 43 | 5.6 | 6.4 | 0.38 | 0.33 | 500 | 400 |
| V1 | 44 | 13.3 | 10.4 | 0.31 | 0.25 | 2300 | 1900 |
| W1 | 45 | 12.4 | 10.1 | 0.50 | 0.44 | 600 | 500 |
| X1 | 46 | 16.4 | 11.2 | 0.38 | 0.50 | 2500 | 2000 |
| Y1 | 47 | 15.0 | 10.5 | 0.50 | 0.56 | 2500 | 2000 |
| Z1 | 48 | 11.6 | 11.5 | 0.50 | 0.38 | 900 | 600 |
| A2 | 49 | 14.7 | 10.9 | 0.56 | 0.38 | 2500 | 800 |

Example 7

Exemplary finish compositions 41 (see Table 17), 47 (see Table 18), and 48 (see Table 18) were prepared and applied to a PIONEER KHAKI fabric, which is a 60% para-aramid and 40% meta-aramid twill. The finish compositions were applied to the fabric samples using a dip finish pad application at 50% to 60% WPU (wet pick-up). The fabrics were then dried and cured using an oven with all zones set at a temperature of 330° F. The speed used for the drying and curing step was 10 yards per minute.

The finished fabric samples were tested for NPFA 1971 water absorption, abrasion resistance, and vertical flammability using char length testing, according to the experimental procedures described in Example 1. All testing was performed both before laundering (indicated as "BW") and after five launderings (indicated as "5×") in accordance with AATCC Test Method 135 described above. The surface abrasion data show the number of taber cycles, as described above, before a first thread break was observed for that sample. The data for samples prepared by applying finish compositions 41, 47, and 48 to the fabric are shown in Table 20.

TABLE 20

| | Finish 41 | Finish 47 | Finish 48 |
|---|---|---|---|
| Vertical Flame Char Length BW [in] (warp × fill) | 0.6 × 0.5 | 0.6 × 0.6 | 0.5 × 0.5 |
| Vertical Flame Char Length AW 5x [in] (warp × fill) | 0.6 × 0.6 | 0.5 × 0.5 | 0.5 × 0.6 |
| Water Absorption BW [%] | 7.2 | 16.5 | 9.9 |
| Water Absorption AW 5x [%] | 5.2 | 8.8 | 7.5 |
| Taber BW | 5000 | 5000 | 1000 |
| Taber AW 5x | 5000 | 4000 | 1000 |

Based on these results, the finish compositions 41, 47, and 48 consistently imparted desirable water absorption properties to the various fabric samples. The water repellency was demonstrated in the finished fabric sample before laundering and was retained in the finished fabric sample after washing. All samples displayed water absorptions values lower than the maximum value of 15% allowed per the NFPA 1971 requirements.

In addition, the finish compositions described herein have no adverse impact on the flame resistant properties of the fabric. The tested treated fabric samples presented in Table 20 exhibited desirable abrasion resistance, as demonstrated by the taber results.

All patents, publications, and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. A water repellant and flame resistant fabric, comprising:

a plurality of spun yarns comprising a plurality of flame resistant fibers; and a finish that imparts water repellency and abrasion resistance to the fabric, the finish comprising: (a) a water repellant agent selected from the group consisting of a hydrocarbon polymer and a silicone-based polymer, wherein the water repellant agent is present in the finish in an amount of 5% to 20% by weight on bath (% owb) and (b) a polymeric abrasion resistance aid, wherein the polymeric abrasion resistance aid is present in the finish in an amount of 5% to 20% by weight on bath (% owb), wherein the finish comprises less than 1 wt. % alkylfluoropolymers;

wherein the fabric, before laundering and after being laundered five times in accordance with AATCC test method 135 (2018), has an abrasion resistance of at least about 500 cycles before a first thread break when tested in accordance with ASTM test method D3884 (2017) (H-18, 500 g on each wheel) and a water absorption of less than or equal to 15.0% as determined by NFPA 1971, 8.26 (2018).

2. The water repellant and flame resistant fabric of claim 1, wherein the finish comprises less than 0.1 wt. % alkylfluoropolymers.

3. The water repellant and flame resistant fabric of claim 1, wherein the water repellant agent comprises a hydrocarbon polymer.

4. The water repellant and flame resistant fabric of claim 1, wherein the water repellant agent comprises a silicone-based polymer.

5. The water repellant and flame resistant fabric of claim 1, wherein the polymeric abrasion resistance aid comprises an acrylic polymer.

6. The water repellant and flame resistant fabric of claim 1, wherein the finish further comprises at least one of an alkoxylated fatty amine or derivative thereof, a melamine formaldehyde resin, an N-methylol stearamide, or combinations thereof.

7. The water repellant and flame resistant fabric of claim 1, wherein at least some of the plurality of flame resistant fibers are inherently flame resistant fibers comprising at least one of meta-aramid fibers, para-aramid fibers, polybenzimidazole fibers, polybenzoxazole fibers, melamine fibers, polyimide fibers, polyimideamide fibers, modacrylic fibers, and FR rayon fibers.

8. The water repellant and flame resistant fabric of claim 1, wherein the abrasion resistance is at least about 700 cycles before a first thread break.

9. The water repellant and flame resistant fabric of claim 1, wherein the abrasion resistance is at least about 1000 cycles before a first thread break.

10. The water repellant and flame resistant fabric of claim 1, wherein the water absorption is less than or equal to 12.0% as determined by NFPA 1971, 8.26 (2018).

11. The water repellant and flame resistant fabric of claim 1, wherein the water absorption is less than or equal to 10.0% as determined by NFPA 1971, 8.26 (2018).

12. The water repellant and flame resistant fabric of claim 1, wherein the water absorption is less than or equal to 5.0% as determined by NFPA 1971, 8.26 (2018).

13. The water repellant and flame resistant fabric of claim 1, wherein the fabric, before laundering and after being laundered five times in accordance with AATCC test method 135 (2018), meets flammability requirements of NFPA 1971 (2018).

14. The water repellant and flame resistant fabric of claim 1, wherein the fabric, before laundering and after being laundered five times in accordance with AATCC test method 135 (2018), meets all water repellency requirements of one or both of NFPA 1951 (2013) or NFPA 1971 (2018).

15. The water repellant and flame resistant fabric of claim 1, wherein the fabric meets total heat loss requirements in accordance with NFPA 1971 (2018).

16. The water repellant and flame resistant fabric of claim 1, wherein the fabric comprises a plain weave, a rip-stop, a twill weave, a sateen weave, or a knitted fabric and wherein the fabric is stretch or non-stretch.

17. The water repellant and flame resistant fabric of claim 1, wherein the fabric has a weight of less than about 8.0 osy.

18. A water repellant flame resistant garment comprising the water repellant and flame resistant fabric of claim 1.

19. A water repellant fabric, comprising:

a plurality of spun yarns comprising a plurality of fibers; and a finish that imparts water repellency and abrasion resistance to the fabric, the finish comprising: (a) a water repellant agent selected from the group consisting of a hydrocarbon_polymer and a silicone-based polymer, wherein the water repellant agent is present in the finish in an amount of 5% to 20% by weight on bath (% owb) and (b) a polymeric abrasion resistance aid, wherein the polymeric abrasion resistance aid is present in the finish in an amount of 5% to 20% by weight on bath (% owb), wherein the finish comprises less than 1 wt. % alkylfluoropolymers;

wherein the fabric, before laundering and after being laundered five times in accordance with AATCC test method 135 (2018), has an abrasion resistance of at least about 500 cycles before a first thread break when tested in accordance with ASTM test method D3884 (2017) (H-18, 500 g on each wheel) and a water absorption of less than or equal to 15.0% as determined by NFPA 1971, 8.26 (2018).

20. The water repellant and flame resistant fabric of claim 1, wherein the finish is free from alkylfluoropolymers.

* * * * *